US006034046A

United States Patent [19]

Blanvalet et al.

[11] Patent Number: 6,034,046

[45] Date of Patent: Mar. 7, 2000

[54] ALL PURPOSE LIQUID BATHROOM CLEANING COMPOSITIONS

[75] Inventors: Claude Blanvalet, Angleur; Isabelle Capron, Liege, both of Belgium

[73] Assignee: Colgate Palmolive Company, New York, N.Y.

[21] Appl. No.: 09/277,836

[22] Filed: Mar. 26, 1999

[51] Int. Cl.[7] ..... C11D 1/90; C11D 3/37; C11D 3/43

[52] U.S. Cl. ..... 510/362; 510/235; 510/237; 510/238; 510/362; 510/361; 510/398; 510/432; 510/490

[58] Field of Search ..... 510/235, 237, 510/238, 362, 361, 398, 432, 490

[56] References Cited

U.S. PATENT DOCUMENTS

| | | | |
|---|---|---|---|
| 5,486,307 | 1/1996 | Misselyn et al. | 252/174.24 |
| 5,534,184 | 7/1996 | Underwood | 510/426 |
| 5,573,702 | 11/1996 | Bonnechere et al. | 510/417 |

*Primary Examiner*—Yogendra Gupta
*Assistant Examiner*—Charles Boyer
*Attorney, Agent, or Firm*—Richard E. Nanfeldt

[57] ABSTRACT

An improvement is described in all purpose liquid bathroom cleaning compositions which are especially effective in the prevention of soap scum buildup containing a zwitterionic surfactant, a glycol ether cosurfactant, an agent for the prevention of soap scum buildup and water.

1 Claim, No Drawings

ALL PURPOSE LIQUID BATHROOM CLEANING COMPOSITIONS

FIELD OF THE INVENTION

The present invention relates to an all purpose bathroom cleaning composition designed to prevent soap scum buildup.

BACKGROUND OF THE INVENTION

This invention relates to an improved all-purpose liquid cleaning composition designed in particular for cleaning hard surfaces and which is effective in preventing soap scum buildup and in leaving unrinsed surfaces with a shiny appearance.

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

WO9844080 A dispensable composition for hard surface cleaning, with improved soil removal, comprises: (a) an anionic, nonionic, amphoteric surfactant and mixtures of these, with optionally a quaternary ammonium surfactant; (b) at least one water-soluble or dispersible organic solvent having a vapour pressure=at least 0.001 mm Hg at 25 deg. C.; (c) a chelating agent selected from tetrapotassium or tetraammonium ethylenediamine tetraacetate, or their mixtures, in an amount to enhance soil removal; (d) a propellant; and (e) water.

EP-875555 A polysaccharide polymer or their mixture is used in a liquid acidic composition used for treating a hard-surface, to reduce the formation of limescale deposits on the surface when it comes in contact with water, once the surface has been treated with the composition. Preferably the composition comprises 0.001–10 (especially 0.01–3, more especially 0.05–0.6) wt. % of the polysaccharide(s) comprising substituted cellulose material or naturally occurring polysaccharide polymer, especially carboxymethylcellulose, ethyl/hydroxyethyl/hydroxypropyl/hydroxymethyl cellulose, succinoglycan, xanthan gum, guar gum, locust bean gum, tragacanth gum and/or their derivatives (especially xanthan gum or its derivatives).

EP-875554 A liquid acidic composition suitable for removing limescale-containing stains from a hard surface and having a pH below 5, the composition comprises 0.01–20% of sulphamic acid, 0.01–45 wt % of a second acid and 0.001–10 wt % of an acid-stable polymer selected from polycarboxylare or sulphonated polystyrene polylmer, a vinylpyrrolidone homo/copolymer and/or polyalkoxylene glycol. USE—The composition is useful for treating a hard-surface, such as in kitchen or bathroom, soiled by limescale containing stains and is used in neat or diluted form to the surface, left on the surface and removed by rinsing.

EP-875552 A liquid acidic composition has a pH of below 5 and comprises 0.1–70 wt. % of an acid and a surfactant system comprising a zwitterionic surfactant and a second surfactant selected from (i) an amine oxide of formula R1R2R3NO, where R1–R3=1–30C alkyl; (ii) an amine of formula R'R"R'"N, where R'=1–30C alkyl; and R", R'"= 1–30C alkyl or H; and/or (iii) a quaternary ammonium surfactant of formula R5R6R7R8N+X–, where X=a counterion; R5=1–30C alkyl; and R6–R8=H or 1–4C alkyl. The weight ratio of the zwitterionic surfactant to the second surfactant is at least 1:1. USE—The composition is useful for treating a hard-surface, such as in kitchens or bathrooms, soiled by limescale containing stains and is used in neat or diluted form to the surface, left on the surface and removed by rinsing.

EP-875551 A liquid acidic thickened composition has a viscosity of at least 10 mPas when measured with a Carrimed rheometer at 5 N/m2 at 20 deg. C. with a 4 cm diameter cone spindle, and a pH below 4, the composition comprises a self thickening system comprising a zwitterionic surfactant and an anionic surfactant at a wt ratio of the zwitterionic to the anionic surfactant of at least 2.1, and 0.1–70 wt. % of an acid. Preferably the zwitterionic surfactant is of formula R9–N+(R10)(R11)R12X–. In the formula, R9=hydrocarbon containing linking groups such as amido or ester (especially 1–24 (especially 8–18)C alkyl or an amido group of formula Ra—C(O)—NRb—(C(Rc)2)m; Ra=8–20C hydrocarbon; Rb=H, short chain alkyl or 1–4C substituted alkyl (especially Me, Et, Pr, OH substituted Et and/or Pr, more especially Me or H); Rc=H or OH; m=1–4 (especially 2–3, more especially 3); there is no more than one OH group in any (C(Rc)2) moiety; R10=H, 1–6C alkyl, hydroxyalkyl or other substituted 1–6C alkyl; R11=as R10 (but can also be joined to R10 to form ring structures with N), 1–6C carboxylic acid group or sulphonate group; R12=moiety joining the cationic nitrogen atom to the hydrophilic group and is especially 1–10C alkylene, hydroxyalkylene or polyalkoxy; X=hydrophilic group, especially carboxylate or sulphonate.

EP-812908 A cleaning composition comprises: (a) a hypochlorite; (b) a hypochlorite compatible surfactant; and (c) a nonionic surfactant of formula: R1–(OR2)nOR3 R1=8–18C alkyl or alkenyl, aryl, or alkaryl group; R2=2–10C alkyl or alkenyl group; and n=1–20. USE—Useful for cleaning bathroom surfaces such as sinks, showers, wash basins, toilets, kitchen sinks, table tops, refrigerators, walls etc.

U.S. Pat. No. 4,347,151 A cleaner-polish comprises 0.3–8 wt. % (A) an anionic or nonionic surfactant which will produce an oil-in-water emulsion; 0–18 wt. % (B) an abrasive; 5–40 wt. % (C) an isoparaffinic hydrocarbon having a kauri-butanol value of 27–29; 1–8 wt. % (D) a polymer having Mn greater than 3000 and soluble in (C), comprising at least 80% cyclohexyl or isobornyl (meth)acrylate, vinyl toluene or tert.-butyl styrene; and 30–90 wt. % (E) water. The composition is useful for treating glass fiber, ceramic and other synthetic surfaces, e.g. in bathrooms and kitchens. It simultaneously cleans and provides a glossy, non-slippery protective film, without adversely affecting the surface or caulking. The film is removed by further treatment.

EP-68359 A cleaner-polish for kitchen and bathroom surfaces, comprising: from 0.3 to 8% of an anionic or nonionic surfactant which will produce an oil in water emulsion; from 0 to 18% by weight of an abrasive agent; from 5 to 40% by weight of an isoparaffinic hydrocarbon having a kauri-butanol value of from 27 to 29; from 1 to 8% by weight of a polymer having Mn of greater than 3,000 and soluble in said isoparaffinic hydrocarbon, said polymer comprising at least 80% of isobornyl acrylate, isobornyl methacrylate, cyclohexyl acrylate, cyclohexyl methacrylate, vinyl toluene, t-butyl styrene or mixtures thereof; and 30 to 90% by weight water.

SUMMARY OF THE INVENTION

The present invention provides an improved, bathroom, liquid cleaning composition having improved interfacial tension which improves cleaning hard surfaces and in preventing soap scum buildup and is suitable for cleaning hard surfaces such as plastic, vitreous and metal surfaces having a shiny finish. More particularly, the improved cleaning compositions exhibit good bathroom greasy soil removal properties due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions impede or decrease the anchoring of soap scum on surfaces that have been cleaned with the instant compositions as compared to surfaces cleaned with a commercial microemulsion composition which means that the soap scum buildup is impeded.

Surprisingly, these desirable results are accomplished even in the absence of polyphosphate and also in the complete absence or substantially complete absence of grease-removal solvent.

In one aspect, the invention generally provides a stable, bathroom cleaning, hard surface cleaning composition especially effective in preventing soap scum buildup. The bathroom cleaning composition includes, on a weight basis:

0.5% to 10% of a zwitterionic surfactant;

0.1% to 10%, more preferably 0.1% to 8% of an agent for preventing soap scum buildup;

0.1% to 10% of a cosurfactant such as water-mixable glycol ether cosurfactant having either limited ability or substantially no ability to dissolve oily or greasy soil; and the balance being water, wherein the composition is not a liquid crystal or microemulsion and does not contain a nonionic surfactant containing ethoxylate groups, an anionic surfactant, an amino alkylene phosphonic acid, EDTA, HEDTA, phosphoric acid, more than 0.3 wt. % of a perfume, water insoluble hydrocarbon having 6 to 24 carbon atoms or an essential oil, a grease release agent, polyvinyl pyrrolidone, polyethylene glycol or a partially or fully esterified ethoxylated polyhydric alcohol or an ethoxylated polyhydric alcohol.

DETAILED DESCRIPTION OF THE INVENTION

The present invention relates to all purpose hard surface cleaning composition comprising approximately by weight 0.1% to 10% of a zwitterionic surfactant, 0 to 10% of an agent for the prevention of soap scum buildup, 0.1% to 10% of a water mixable glycol ether cosurfactant, and the balance being water, wherein the composition is not a liquid crystal or microemulsion and does not contain a nonionic surfactant containing ethoxylate groups, an anionic surfactant, amino alkylene phosphonic acid, EDTA, HEDTA, phosphoric acid, an aliphatic acid or hydroxy aliphatic acid, more than 0.3 wt. % of a perfume, water insoluble hydrocarbon having 6 to 18 carbon atoms or an essential oil, a grease release agent, polyvinyl pyrrolidone, polyethylene glycol or a partially or fully esterified ethoxylated polyhydric alcohol or an ethoxylated polyhydric alcohol.

An object of the present invention is the use of a bathroom liquid cleaning composition of an agent which prevents soap scum buildup by the complexing of the calcium ions in the soap scum into a solubilized form thereby preventing removal by a rinsing process.

The water-soluble organic surfactant materials which are used in forming the bathroom cleaning compositions of this invention are zwitterionic surfactants. The water-soluble zwitterionic surfactant is used at a concentration of 0.1 wt. % to 10 wt. %, more preferably 0.5 wt. % to 8 wt. %. The zwitterionic surfactant is a water soluble betaine having the general formula:

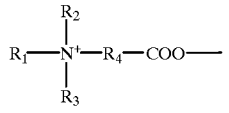

wherein $R_1$ is an alkyl group having 10 to 20 carbon atoms, preferably 12 to 16 carbon atoms, or the amido radical:

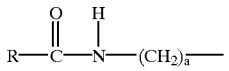

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N,N-dimethylammonio) acetate, myristyl dimethyl betaine, palmityl dimethyl betaine, lauryl diemethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

Suitable cosurfactants for the bathroom cleaning compositions are glycerol, mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4.

Satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

The agent for preventing soap scum buildup is used in the instant composition at a concentration of 0.1 wt. % to 10 wt. %, more preferably 0.3 wt. % to 8 wt. %. The soap scum agent is selected from the group consisting of the trisodium salt of methyl glycine diacetic acid (MGDA) having the structure $NaOOCCH(CH_3)N(CH_2COONa)_2$ polyaspartic acids having the structure of:

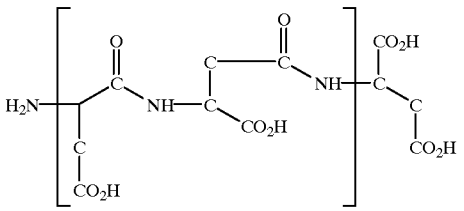

having a mean molecular mass of 1,500 to 3,000 gram/mole; iminodisuccinic (IDSNa) acid sodium salt having the structure

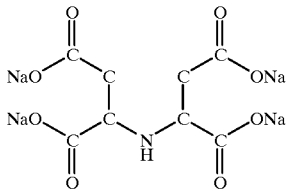

and glutamic acid-N,N-diacetic acid sodium salt (Nervanaid GBS5) and mixtures thereof.

Another agent for the prevention of soap scum buildup which can be used alone at the aforementioned concentration or in combination with the aforementioned agents for preventing soap scum buildup is a sodium salt of a copolymer of maleic anhydride and olefin sold by Norsohas as Norasol 460ND™ and having a molecular weight of about 10,000 such as a copolymer of maleic anhydride and ethylene having a molecular weight of 1,000 to 100,000, more preferably 2,000 to 50,000.

The proportion of water in the all purpose hard surface cleaning composition compositions generally is in the range of 20% to 97%, preferably 70% to 97% by weight.

The all-purpose bathroom liquid cleaning composition of this invention may, if desired, also contain other components either to provide additional effect or to make the product more attractive to the consumer. The following are mentioned by way of example: Colors or dyes in amounts up to 0.5% by weight; bactericides/fongicides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

The all-purpose bathroom hard surface liquid cleaning compositions exhibit stability at reduced and increased temperatures. More specifically, such compositions remain clear and stable in the range of 5° C. to 50° C., especially 10° C. to 43° C. Such compositions exhibit a pH in the alkaline range. The liquids are readily pourable and exhibit a viscosity in the range of 6 to 60 millipascal. second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the compositions which are easily prepared simply by combining all the ingredients in a suitable vessel or container. The order of mixing the ingredients is not particularly important and generally the various ingredients can be added sequentially or all at once or in the form of aqueous solutions of each. It is not necessary to use elevated temperatures in the formation step and room temperature is sufficient.

The instant compositions explicitly exclude alkali metal silicates and alkali metal builders such as alkali metal polyphosphates, alkali metal carbonates, alkali metal phosphonates and alkali metal citrates because these materials, if used in the instant composition, would cause the composition to leave a residue on the surface being cleaned.

The following examples illustrate the bathroom liquid cleaning compositions of the described invention. Unless otherwise specified, all percentages are by weight.

The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing at 25° C.:

| | A | B | C | D | Reference Clean Shower U.S. Pat. No. 5,587,022 |
|---|---|---|---|---|---|
| Cocoamidopropyl betaine | 1.4 | 1.4 | 1.4 | 1.4 | |
| Antarox BL-225(Gaf)[1] | | | | | 1.5 |
| Propylene glycol n-butyl ether | 2.0 | 2.0 | 2.0 | 2.0 | |
| Isopropyl alcohol | | | | | 4.4 |
| Ammonium EDTA | | | | | 0.66 |
| MGDA | 2.0 | | | | |
| Glutanic acid-N,N-Diacetate sodium salt | | 2.0 | | | |
| Norasol 460ND | | | 2.0 | | |
| IDS Na | | | | 2.0 | |
| Perfume | | | | | 0.3 |
| Water | | | | | |
| Soap scum inhibition test[1] | 0.45 ml | 0.45 ml | 0.15 ml | 0.60 ml | 1.00 |
| Film homogeneity | better | better | best | better | standard |
| Film transparency (1 day) | slightly better | slightly better | best | slightly better | standard |

[1]Volume of 0.25M calcium acetate that can be added to a mixture of 10 ml Na oleate (0.25M) and 10 ml of the product to test without formation of calcium oleate. Antarox BL-225 is sold by GAF; and is Modified aliphatic polyether.

What is claimed:

1. A liquid cleaning composition comprising approximately by weight:

(a) 0.1% to 10% of a zwitterionic surfactant;

(b) 0.1% to 10% of a glycol ether cosurfactant;

(c) 0.1% to 10% of an agent for the prevention of soap scum buildup, wherein said agent is selected from the group consisting of a trisodium salt of methyl glycine diacetic acid, a polyaspartic acid, imino disuccinic acid sodium salt and glutamic acid -N,N-diacetic acid sodium salt;

(d) a copolymer of ethylene and maleic anhydride (e) the balance being water.

* * * * *